US011568815B2

(12) United States Patent
Yu et al.

(10) Patent No.: US 11,568,815 B2
(45) Date of Patent: Jan. 31, 2023

(54) PIXEL DRIVING CIRCUIT, MANUFACTURING METHOD THEREOF, AND DISPLAY DEVICE

(71) Applicant: BOE TECHNOLOGY GROUP CO., LTD., Beijing (CN)

(72) Inventors: Yang Yu, Beijing (CN); Zheng Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/329,027

(22) Filed: May 24, 2021

(65) Prior Publication Data

US 2022/0101793 A1 Mar. 31, 2022

(30) Foreign Application Priority Data

Sep. 29, 2020 (CN) ..... 202011058006.6

(51) Int. Cl.
*G09G 3/3258* (2016.01)

(52) U.S. Cl.
CPC ..... *G09G 3/3258* (2013.01); *G09G 2300/0426* (2013.01)

(58) Field of Classification Search
CPC ..... G09G 3/3258; G09G 2300/0426
See application file for complete search history.

(56) References Cited

U.S. PATENT DOCUMENTS

| | | | | |
|---|---|---|---|---|
| 11,011,113 | B1 * | 5/2021 | Lu | G09G 3/3225 |
| 2011/0157125 | A1 * | 6/2011 | Choi | G09G 3/3291 315/160 |
| 2015/0348464 | A1 * | 12/2015 | In | G09G 3/2022 345/82 |
| 2020/0035164 | A1 * | 1/2020 | Qing | G09G 3/3266 |
| 2020/0043413 | A1 * | 2/2020 | Xie | G09G 3/3258 |
| 2020/0203461 | A1 * | 6/2020 | Chen | G09G 3/3258 |

FOREIGN PATENT DOCUMENTS

| | | | |
|---|---|---|---|
| CN | 108806596 | A | 11/2018 |
| CN | 109389937 | A | 2/2019 |
| CN | 110197644 | A | 9/2019 |
| CN | 111179854 | A | 5/2020 |
| CN | 111508429 | A | 8/2020 |

OTHER PUBLICATIONS

First Office Action for Chinese Application No. 202011058006.6, dated May 7, 2021, 10 Pages.

* cited by examiner

*Primary Examiner* — Hong Zhou
(74) *Attorney, Agent, or Firm* — Brooks Kushman P.C.

(57) ABSTRACT

The present disclosure provides a pixel driving circuit, a manufacturing method thereof, and a display device. In the pixel driving circuit, a first terminal of a coupling sub-circuit is electrically connected to a control terminal of a driving sub-circuit; a second compensation sub-circuit is electrically connected to a first control terminal, a second terminal of the coupling sub-circuit and a first level signal input terminal, respectively; the pixel driving circuit is configured to control the connection or disconnection between the second terminal of the coupling sub-circuit and the first level signal input terminal under the control of the first control terminal.

14 Claims, 14 Drawing Sheets

PIXEL DRIVING CIRCUIT, MANUFACTURING METHOD THEREOF, AND DISPLAY DEVICE

CROSS-REFERENCE TO RELATED APPLICATION

This application claims priority to Chinese Patent Application No. 202011058006.6 filed on Sep. 29, 2020 which is incorporated herein by reference in its entirety.

TECHNICAL FIELD

The present disclosure relates to the field of display technique, in particular to a pixel driving circuit, a manufacturing method thereof, and a display device.

BACKGROUND

Active Matrix Organic Light-Emitting Diode (AMOLED) display has the advantages of high contrast, bright color and being able to control each pixel individually, and it is currently a very popular display device.

The AMOLED display includes a plurality of pixels arranged in an array, and a pixel driving circuit within the pixel is used to drive and control each pixel for gray scale display, the pixel driving circuit mainly includes: a switch, a capacitor, an Organic Light-Emitting Diode (OLED) light-emitting element, and a driving transistor. In operation, the driving transistor in each pixel drives the corresponding OLED light-emitting element to emit light to achieve the self-emission function of the AMOLED display. However, there are threshold voltage shift for the driving transistor in the AMOLED display. In operation, the threshold voltage of the driving transistor will affect the operating current of the light-emitting device, thereby affecting the display quality of the display.

SUMMARY

A first aspect of the present disclosure provides a pixel driving circuit for driving a light-emitting element to emit light, comprising:

a first storage sub-circuit, wherein a first terminal of the first storage sub-circuit is electrically connected to a first level signal input terminal;

a driving sub-circuit, wherein a control terminal of the driving sub-circuit is electrically connected to a second terminal of the first storage sub-circuit, and a second terminal of the driving sub-circuit is electrically connected to the light-emitting element;

a power supply control sub-circuit, respectively electrically connected to a first control terminal, the first level signal input terminal and a first terminal of the driving sub-circuit;

a data writing sub-circuit, respectively electrically connected to a second control terminal, a data signal input terminal and the first terminal of the driving sub-circuit;

a first compensation sub-circuit, respectively electrically connected to the second control terminal, the second terminal of the driving sub-circuit and the control terminal of the driving sub-circuit;

a first reset sub-circuit, respectively electrically connected to a reset control terminal, an initialization signal input terminal and the control terminal of the driving sub-circuit;

a coupling sub-circuit, wherein a first terminal of the coupling sub-circuit is electrically connected to the control terminal of the driving sub-circuit; and a second compensation sub-circuit, respectively electrically connected to the first control terminal, a second terminal of the coupling sub-circuit and the first level signal input terminal, and configured to control the connection or disconnection between the second terminal of the coupling sub-circuit and the first level signal input terminal under a control of the first control terminal.

Optionally, the pixel driving circuit further includes:

a second storage sub-circuit, wherein a first terminal of the second storage sub-circuit is electrically connected to the first level signal input terminal; and a storage control sub-circuit, respectively electrically connected to a storage control terminal, a second terminal of the second storage sub-circuit and the control terminal of the driving sub-circuit, and configured to control the connection or disconnection between the second terminal of the second storage sub-circuit and the control terminal of the driving sub-circuit under the control of the storage control terminal.

Optionally, the pixel driving circuit further includes:

a second reset sub-circuit, respectively electrically connected to a reset control terminal, the initialization signal input terminal and the second terminal of the coupling sub-circuit, and configured to control the connection or disconnection between the initialization signal input terminal and the second terminal of the coupling sub-circuit under the control of the reset control terminal.

Optionally, the pixel driving circuit further includes a light-emitting control sub-circuit, wherein the second terminal of the driving sub-circuit is electrically connected to the light-emitting element through the light-emitting control sub-circuit; and the light-emitting control sub-circuit is respectively electrically connected to the first control terminal, the second terminal of the driving sub-circuit, and the light-emitting element, and configured to control the connection or disconnection between the second terminal of the driving sub-circuit and the light-emitting element under the control of the first control terminal.

Optionally, the pixel driving circuit further includes:

a third reset sub-circuit, respectively electrically connected to the second control terminal, the initialization signal input terminal and the light-emitting element, and configured to control the connection or disconnection between the initialization signal input terminal and the light-emitting element under the control of the second control terminal.

Optionally, one or more of the first reset sub-circuit, the first compensation sub-circuit, and the storage control sub-circuit are implemented using an oxide transistor.

Optionally, the first storage sub-circuit includes a first storage capacitor, and a first terminal of the first storage capacitor is electrically connected to the first level signal input terminal.

Optionally, the driving sub-circuit includes a third transistor, a gate electrode of the third transistor is electrically connected to a second terminal of the first storage capacitor, and a second electrode of the third transistor is electrically connected to the light-emitting element.

Optionally, the first reset sub-circuit includes a first transistor, a gate electrode of the first transistor is electrically connected to the reset control terminal, a first electrode of the first transistor is electrically connected to the initialization signal input terminal, and a second electrode of the first transistor is electrically connected to the gate electrode of the third transistor.

Optionally, the first compensation sub-circuit includes a second transistor, a first electrode of the second transistor is electrically connected to the second control terminal, the first electrode of the second transistor is electrically connected to the second electrode of the third transistor, and a second electrode of the second transistor is electrically connected to the gate electrode of the third transistor.

Optionally, the data writing sub-circuit includes a fourth transistor, a gate electrode of the fourth transistor is electrically connected to the second control terminal, a first electrode of the fourth transistor is electrically connected to the data signal input terminal, and a second electrode of the fourth transistor is electrically connected to a first electrode of the third transistor.

Optionally, the power control sub-circuit includes a fifth transistor, a gate electrode of the fifth transistor is electrically connected to the first control terminal, a first electrode of the fifth transistor is electrically connected to the first level signal input terminal, and a second electrode of the fifth transistor is electrically connected to a first electrode of the third transistor;

the coupling sub-circuit includes a coupling capacitor, wherein a first terminal of the coupling capacitor is electrically connected to the gate electrode of the third transistor; and the second compensation sub-circuit includes a ninth transistor, wherein a gate electrode of the ninth transistor is electrically connected to the first control terminal, a first electrode of the ninth transistor is electrically connected to the first level signal input terminal, and a second electrode of the ninth transistor is electrically connected to a second terminal of the coupling capacitor.

Optionally, the second reset sub-circuit includes an eighth transistor, a gate electrode of the eighth transistor is electrically connected to the reset control terminal, a first electrode of the eighth transistor is electrically connected to the initialization signal input terminal, and a second electrode of the eighth transistor is electrically connected to the second terminal of the coupling capacitor.

Optionally, the second storage sub-circuit includes a second storage capacitor, wherein a first terminal of the second storage capacitor is electrically connected to the first level signal input; and the storage control sub-circuit includes a tenth transistor, a gate electrode of the tenth transistor is electrically connected to the storage control terminal, a first electrode of the tenth transistor is electrically connected to a second terminal of the second storage capacitor, and a second electrode of the tenth transistor is electrically connected to the control terminal of the driving sub-circuit.

Optionally, the light-emitting control sub-circuit includes a sixth transistor, a gate electrode of the sixth transistor is electrically connected to the first control terminal, a first electrode of the sixth transistor is electrically connected to the second terminal of the driving sub-circuit, and a second electrode of the sixth transistor is electrically connected to the light-emitting element.

Optionally, the third reset sub-circuit includes a seventh transistor, a gate electrode of the seventh transistor is electrically connected to the second control terminal, a first electrode of the seventh transistor is electrically connected to the initialization signal input terminal, and a second electrode of the seventh transistor is electrically connected to the light-emitting element.

Based on the above technical solution of the pixel driving circuit, a second aspect of the present disclosure provides a display device including the above pixel driving circuit.

Based on the above technical solution of the pixel driving circuit, a third aspect of the present disclosure provides a method for driving the pixel driving circuit according to claim 1, comprising: within each display period, in a reset phase, under a control of a reset control terminal, a first reset sub-circuit controlling the connection between an initialization signal input terminal and a control terminal of a driving sub-circuit to reset the control terminal of the driving sub-circuit;

in a compensation phase, under the control of the reset control terminal, the first reset sub-circuit controlling the disconnection between the initialization signal input terminal and the control terminal of the driving sub-circuit; under the control of a second control terminal, a first compensation sub-circuit controlling the connection between a second terminal of the driving sub-circuit and the control terminal of the driving sub-circuit; a data signal input terminal inputting a data signal, and under the control of the second control terminal, a data writing sub-circuit controlling the connection between the data signal input terminal and a first terminal of the driving sub-circuit; a potential of the control terminal of the driving sub-circuit being compensated to Vdata+Vth, wherein Vth is a threshold voltage corresponding to the driving sub-circuit, and Vdata is a voltage value of a data signal; and in the light-emitting phase, under the control of the second control terminal, the first compensation sub-circuit controlling the disconnection between the second terminal of the driving sub-circuit and the control terminal of the driving sub-circuit; under the control of the second control terminal, the data writing sub-circuit controlling the disconnection between the data signal input terminal and the first terminal of the driving sub-circuit; the first level signal input terminal inputting a first level signal, and under the control of the first control terminal, a power supply control sub-circuit controlling the connection between the first level signal input terminal and the first terminal of the driving sub-circuit; under the control of the first control terminal, a second compensation sub-circuit controlling the connection between the first level signal input terminal and a second terminal of a coupling sub-circuit, so that a potential of the control terminal of the driving sub-circuit is changed to Vdata+Vth+Vd−V1, wherein V1 is an initial voltage of the second terminal of the coupling sub-circuit, and Vd is a voltage value of the first level signal, and the driving sub-circuit drives a light-emitting element to emit light.

Optionally, the pixel driving circuit is applied to a display device, and when the pixel driving circuit further includes a second storage sub-circuit and a storage control sub-circuit, the method further includes the following steps:

when the display device is at a first operating frequency, under the control of a storage control terminal, the storage control sub-circuit controlling the disconnection between a second terminal of a second storage sub-circuit and the control terminal of the driving sub-circuit; and when the display device is at a second operating frequency, under the control of the storage control terminal, the storage control sub-circuit controlling the connection between the second terminal of the second storage sub-circuit and the control terminal of the driving sub-circuit, wherein the second operating frequency is less than the first operating frequency.

Optionally, when the pixel driving circuit further includes a second reset sub-circuit, the method further includes the following steps:

in the reset phase, under the control of a reset control terminal, the second reset sub-circuit controlling the connection between the initialization signal input terminal and the second terminal of the coupling sub-circuit; and in the compensation phase and the light-emitting phase, under the control of the reset control terminal, the second reset sub-circuit controlling the disconnection between the initialization signal input terminal and the second terminal of the coupling sub-circuit.

BRIEF DESCRIPTION OF THE DRAWINGS

The drawings, which are illustrated herein, are to provide a further understanding of the disclosure and constitute a part of the disclosure. Embodiments of the disclosure together with the description serve to explain the disclosure and are not used to limit the disclosure. In the drawings.

DETAILED DESCRIPTION

In order to further explain the pixel driving circuit, the manufacturing method thereof and the display device provided by the embodiments of the present disclosure, the following detailed description is made with reference to the accompanying drawings.

Figure 1:
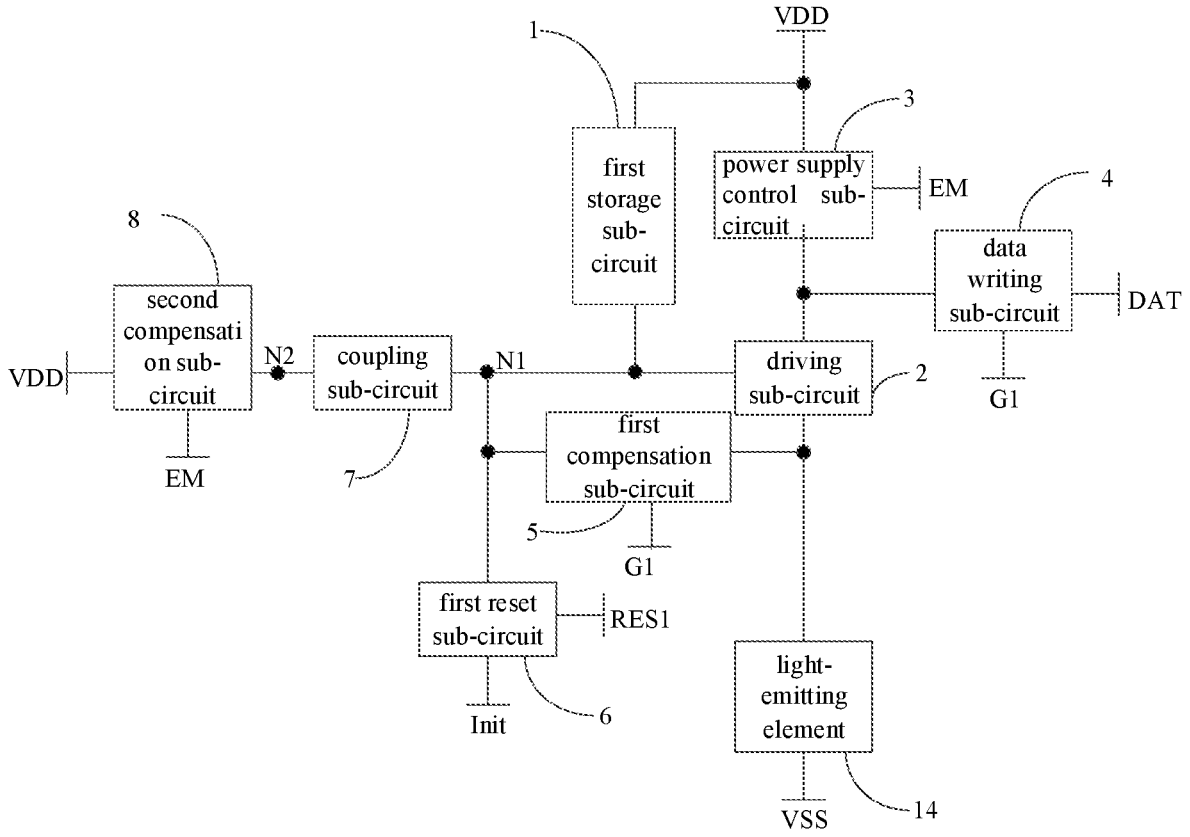
FIG. 1 is a schematic diagram of a first basic structure of a pixel driving circuit provided by an embodiment of the present disclosure.

Referring to FIG. 1, an embodiment of the present disclosure provides a pixel driving circuit for driving a light-emitting element 14 to emit light, including:

a first storage sub-circuit 1, wherein a first terminal of the first storage sub-circuit 1 is electrically connected to a first level signal input terminal VDD;

a driving sub-circuit 2, wherein a control terminal of the driving sub-circuit 2 is electrically connected to a second terminal of the first storage sub-circuit 1, and a second terminal of the driving sub-circuit 2 is electrically connected to the light-emitting element 14;

a power supply control sub-circuit 3, respectively electrically connected to a first control terminal EM, the first level signal input terminal VDD and a first terminal of the driving sub-circuit 2;

a data writing sub-circuit 4, respectively electrically connected to a second control terminal G1, a data signal input terminal DAT and the first terminal of the driving sub-circuit 2;

a first compensation sub-circuit 5, respectively electrically connected to the second control terminal G1, the second terminal of the driving sub-circuit 2 and the control terminal of the driving sub-circuit 2;

a first reset sub-circuit 6, respectively electrically connected to a reset control terminal RES1, an initialization signal input terminal Iint and the control terminal of the driving sub-circuit 2;

a coupling sub-circuit 7, wherein a first terminal of the coupling sub-circuit 7 is electrically connected to the control terminal of the driving sub-circuit 2; and a second compensation sub-circuit 8, respectively electrically connected to the first control terminal EM, a second terminal of the coupling sub-circuit 7 and the first level signal input terminal VDD, and configured to control connection or disconnection between the second terminal of the coupling sub-circuit 7 and the first level signal input terminal VDD under a control of the first control terminal EM.

Illustratively, the first level signal inputted by the first level signal input terminal VDD includes a positive power supply signal.

Illustratively, the light-emitting element 14 includes an OLED light-emitting element, an anode of the light-emitting element 14 is electrically connected to a second terminal of the driving sub-circuit 2, and a cathode of the light-emitting element 14 is electrically connected to a second level signal input terminal VSS, and a second level signal inputted by the second level signal input terminal includes a negative power supply signal.

Referring to FIGS. 1 and 6-10, the pixel driving circuit operates in one driving cycle as follows.

In a reset phase P1, the initialization signal input terminal Iint inputs an initialization signal having a voltage Vinit and the reset control signal inputted by the reset control terminal RES1 is at a valid level, and under the control of the reset control terminal RES1, the first reset sub-circuit 6 controls the connection between the initialization signal input terminal Tint and the control terminal (namely, the N1 node) of the driving sub-circuit 2, changes the potential of the control terminal of the driving sub-circuit 2 to Vinit, and resets the control terminal of the driving sub-circuit 2.

In a compensation phase P2, the reset control signal inputted by the reset control terminal RES1 is at an invalid level, and under the control of the reset control terminal RES1, the first reset sub-circuit 6 controls the disconnection between the initialization signal input terminal Tint and the control terminal of the driving sub-circuit 2; the second control signal inputted by the second control terminal G1 is at a valid level, and under the control of the second control terminal G1, the first compensation sub-circuit 5 controls the connection between the second terminal of the driving sub-circuit 2 and the control terminal of the driving sub-circuit 2; the data signal input terminal DAT inputs a data signal, and under the control of the second control terminal G1, the data writing sub-circuit 4 controls the connection between the data signal input terminal DAT and the first terminal of the driving sub-circuit 2; in the compensation phase, the driving sub-circuit 2 is formed in a diode structure, and a data signal Vdata is transmitted to the control terminal of the driving sub-circuit 2 via the data writing sub-circuit 4 and the driving sub-circuit 2, so that the threshold voltage of the driving sub-circuit 2 is compensated, and when the compensation time is sufficiently long, the potential of the control terminal of the driving sub-circuit 2 is compensated to Vdata+Vth, wherein Vth is a threshold voltage corresponding to the driving sub-circuit 2 and Vdata represents a data signal voltage value.

In a light-emitting phase P3, the second control signal inputted by the second control terminal G1 is at an invalid level, and under the control of the second control terminal G1, the first compensation sub-circuit 5 controls to the disconnection between the second terminal of the driving sub-circuit 2 and the control terminal of the driving sub-circuit 2; the second control signal inputted by the second control terminal G1 is at an invalid level, and under the control of the second control terminal G1, the data writing sub-circuit 4 controls the disconnection between the data signal input terminal DAT and the first terminal of the driving sub-circuit 2; the first level signal input terminal VDD inputs a first level signal, the first control signal inputted by the first control terminal EM is at a valid level, and under the control of the first control terminal EM, the power supply control sub-circuit 3 controls the connection between the first level signal input terminal VDD and the first terminal of the driving sub-circuit 2, and changes the voltage of the first terminal of the driving sub-circuit 2 to Vd; under the control of the first control terminal EM, the second compensation sub-circuit 8 controls to the connection between the first level signal input terminal VDD and the second terminal (namely, the N2 node) of the coupling sub-circuit 7, so that the voltage of the N2 node changes from the initial voltage V1 to Vd, namely, the voltage changing amount of the N2 node is Vd−V1; under the bootstrapping of the coupling sub-circuit 7, the voltage of the control terminal of the driving sub-circuit 2 becomes Vdata+Vth+Vd−V1, wherein V1 is the initial voltage of the second terminal of the coupling sub-circuit 7, and Vd is the voltage value of the first level signal, so that the driving sub-circuit 2 drives the light-emitting element 14 to emit light.

In the light-emitting phase P3, the gate-source voltage Vgs corresponding to the driving sub-circuit 2 is:

$$Vgs=V\text{data}+V\text{th}+Vd-V1-Vd, \quad \text{Equation (1)}$$

The driving current I generated when the driving sub-circuit 2 operates in a saturated state is:

$$I=k(Vgs-V\text{th})^2 \quad \text{Equation (2)}$$

Substituting Equation (1) into Equation (2) yields:

$$I=k(V\text{data}+V\text{th}-V1-V\text{th})^2=k(V\text{data}-V1)^2 \quad \text{Equation (3)}$$

In Equation (3), k is a constant related to the channel length to width ratio and mobility of the driving transistor in the driving sub-circuit 2.

It can be seen from Equation (3) that the driving current I is related only to the data voltage Vdata and the initial voltage V1 of the second terminal of the coupling sub-circuit 7, and not related to both the threshold voltage Vth corresponding to the driving sub-circuit 2 and the voltage value Vd of the first level signal; therefore, the embodiment of the present disclosure provides a pixel driving circuit capable of compensating both the threshold voltage Vth corresponding to the driving sub-circuit 2 and the voltage value Vd of the first level signal, eliminating the influence of Vth drift and the variation of Vd due to IR Drop on the driving current I, and effectively improving the display quality of the display device.

Figure 19:
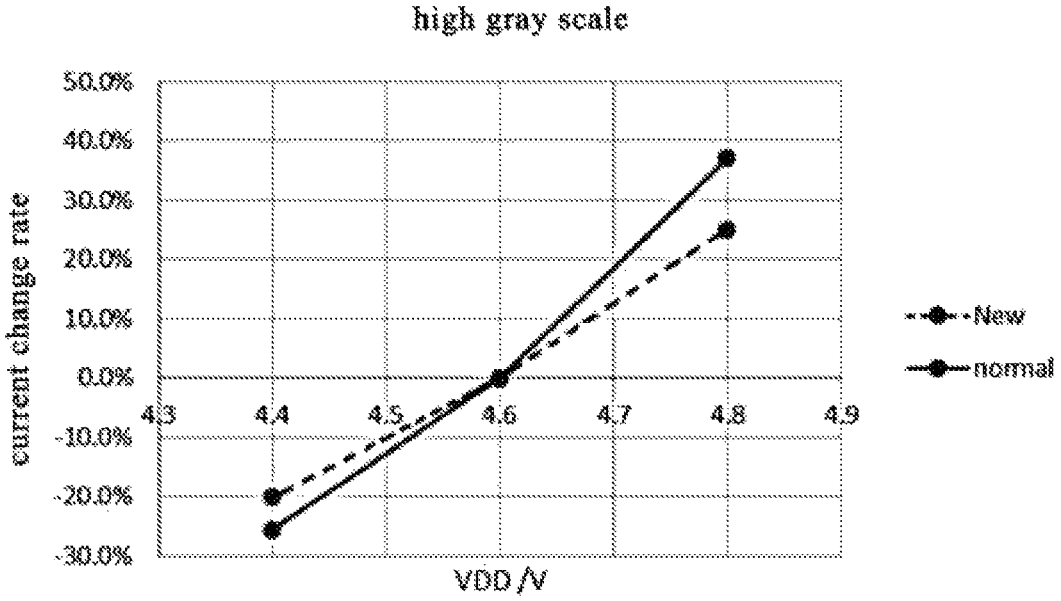
FIG. 19 is a diagram showing a corresponding relationship between the current change rate and the first level signal of the present application and the related art in a high gray scale display.
Figure 20:
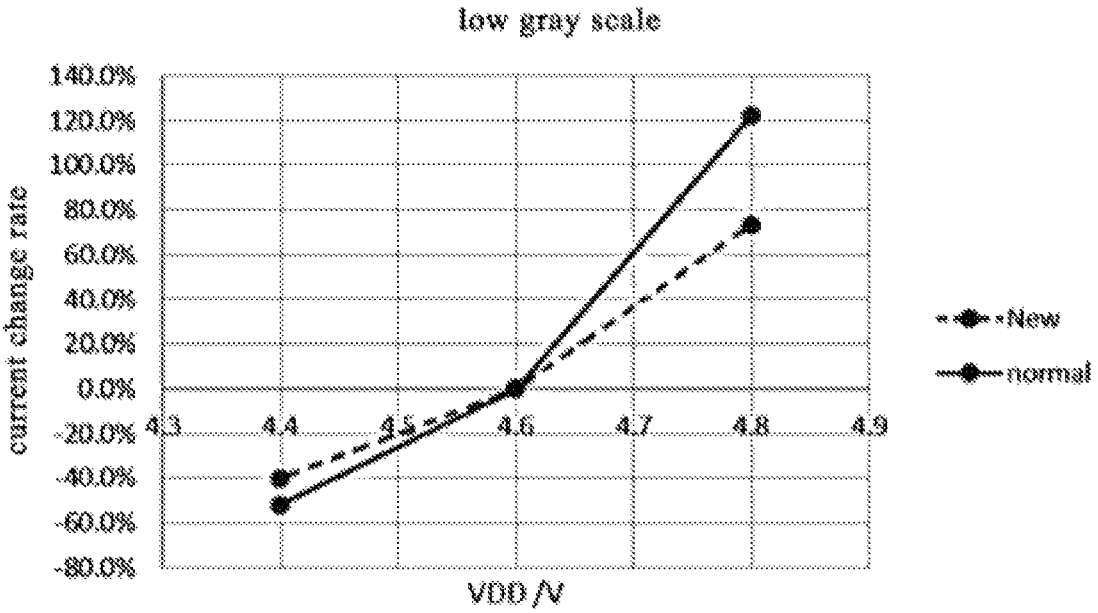
FIG. 20 is a diagram showing a corresponding relationship between the current change rate and the first level signal of the present application and the related art in a low gray scale display.

More specifically, as shown in FIG. 19, it shows the change rate of the driving current when Vd changes in a high gray scale. As shown in FIG. 20, it shows the change rate of the driving current when Vd changes in a low gray scale. As can be seen, the embodiment of the present disclosure provides a pixel driving circuit (see the broken lines in FIGS. 19 and 20) in which the variation of the driving current is smaller when Vd varies, as compared with the related art (see the solid lines in FIGS. 19 and 20).

Figure 2:
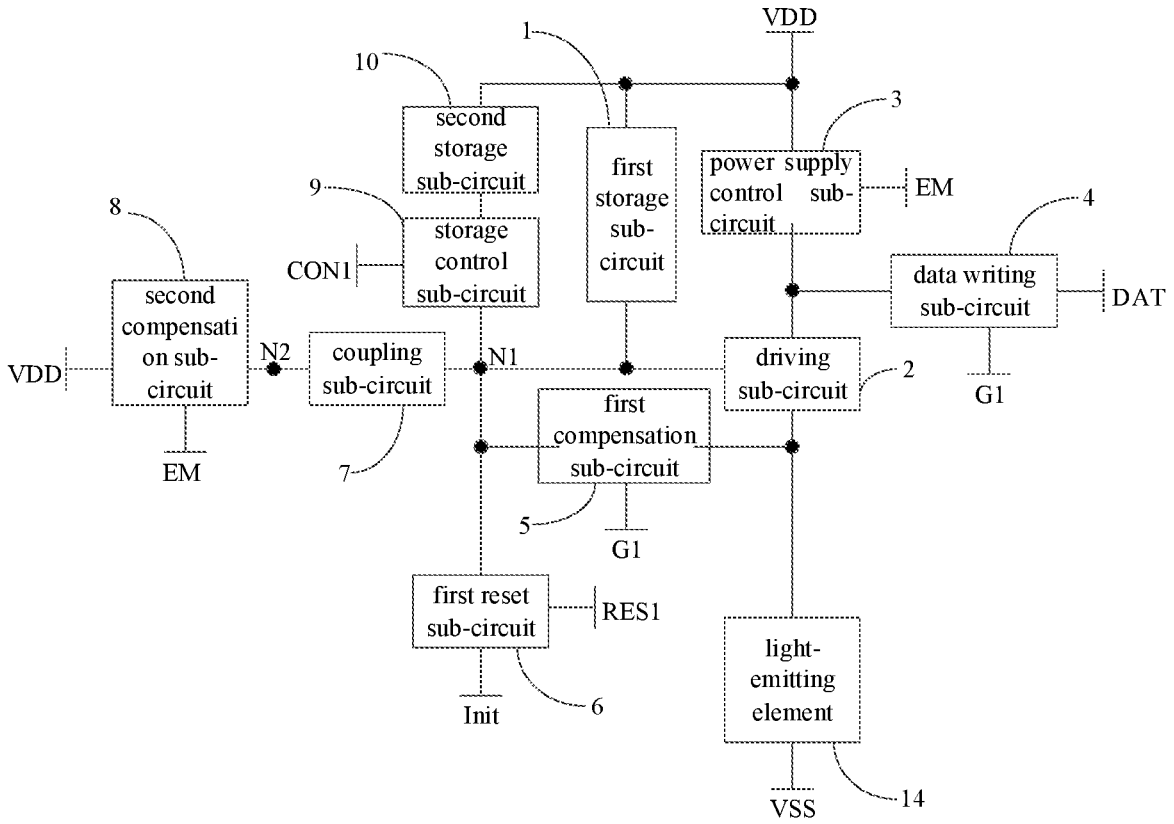
FIG. 2 is a schematic diagram of a second basic structure of a pixel driving circuit provided by an embodiment of the present disclosure.
Figure 3:
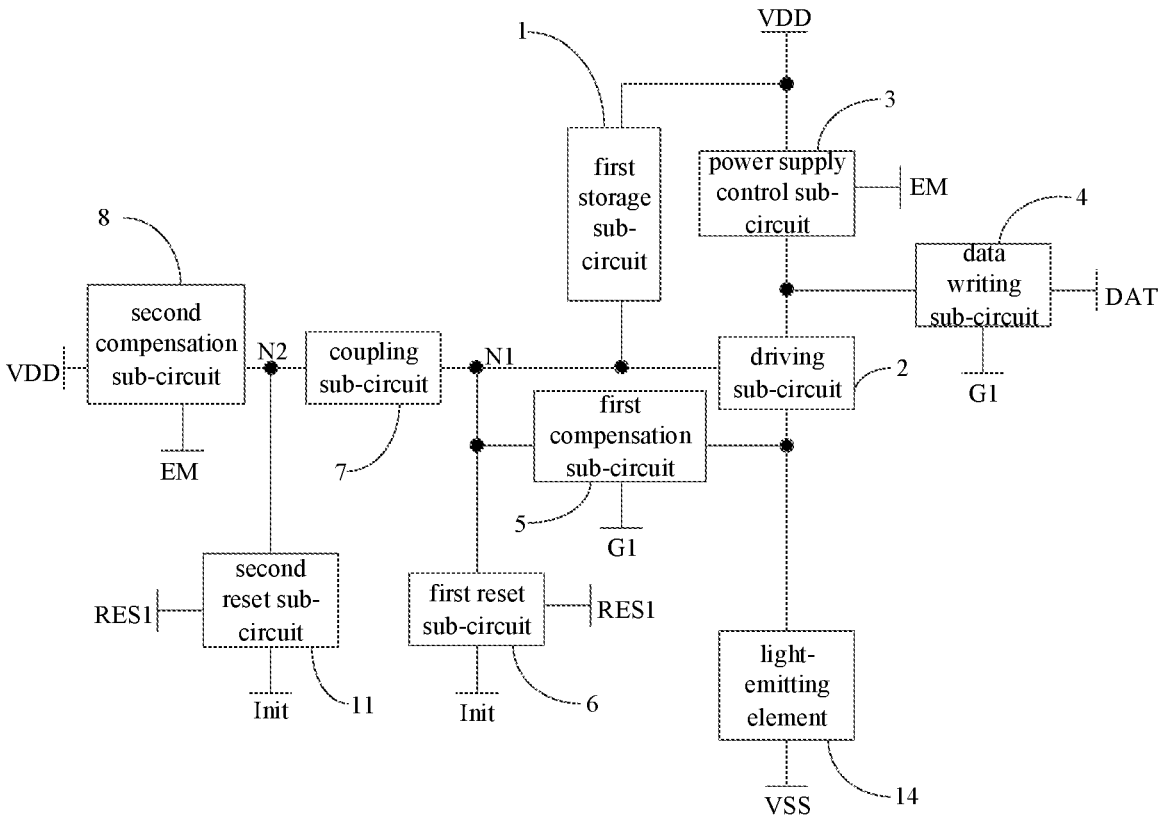
FIG. 3 is a schematic diagram of a third basic structure of a pixel driving circuit provided by an embodiment of the present disclosure.
Figure 4:
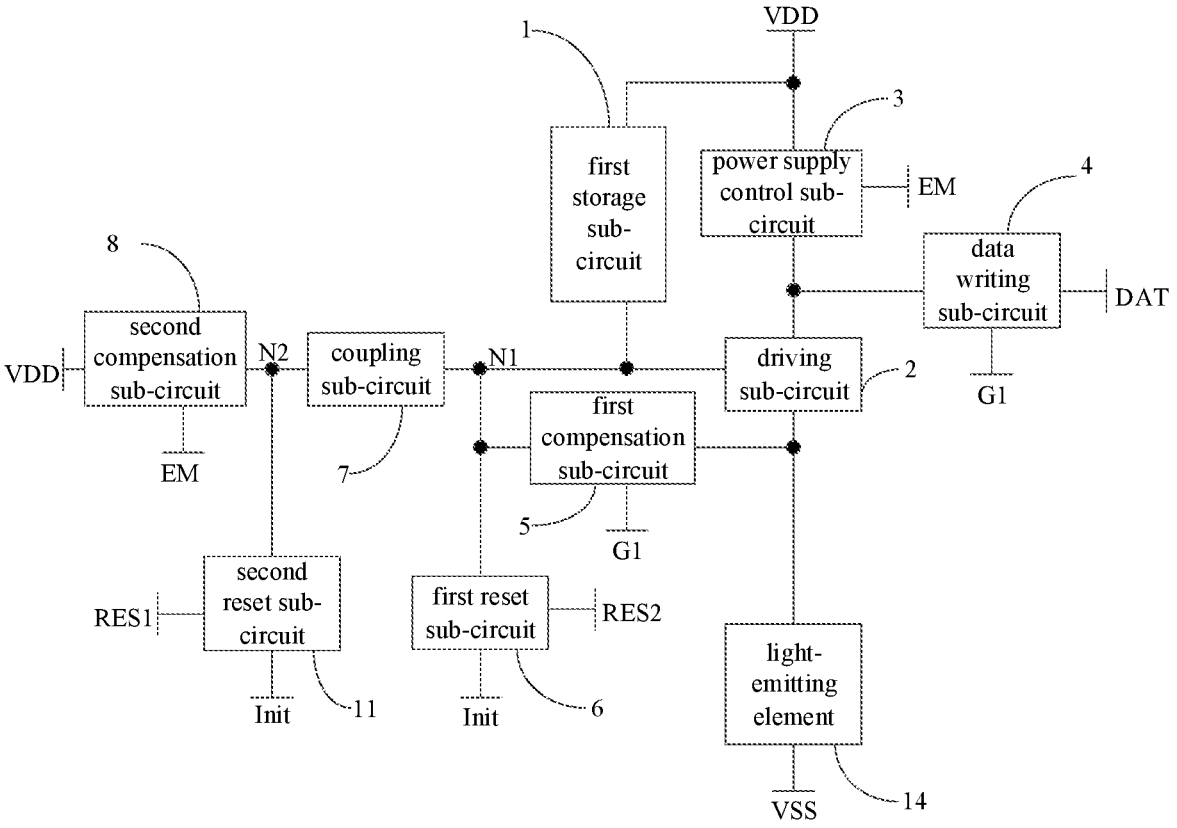
FIG. 4 is a schematic diagram of a fourth basic structure of a pixel driving circuit provided by an embodiment of the present disclosure.

As shown in FIG. 2, in some embodiments, the pixel driving circuit further includes:

a second storage sub-circuit 10, wherein a first terminal of the second storage sub-circuit 10 is electrically connected to the first level signal input terminal VDD; and a storage control sub-circuit 9, respectively electrically connected to a storage control terminal CON1, a second terminal of the second storage sub-circuit 10 and the control terminal of the driving sub-circuit 2, and configured to control to the connection or disconnection between the second terminal of the second storage sub-circuit 10 and the control terminal of the driving sub-circuit 2 under the control of the storage control terminal CON1.

Specifically, when it is required that the display device can operate at both a higher display frequency (e.g. 90 Hz or 120 Hz) and a lower display frequency (e.g. 1 Hz or 10 Hz), the contradiction between the charging rate and the voltage maintaining rate of the pixel driving circuit becomes more prominent. The higher display frequency requires less storage capacitance to ensure the charging rate, while the lower display frequency requires as much storage capacitance as possible to reduce the voltage change rate.

Figure 13:
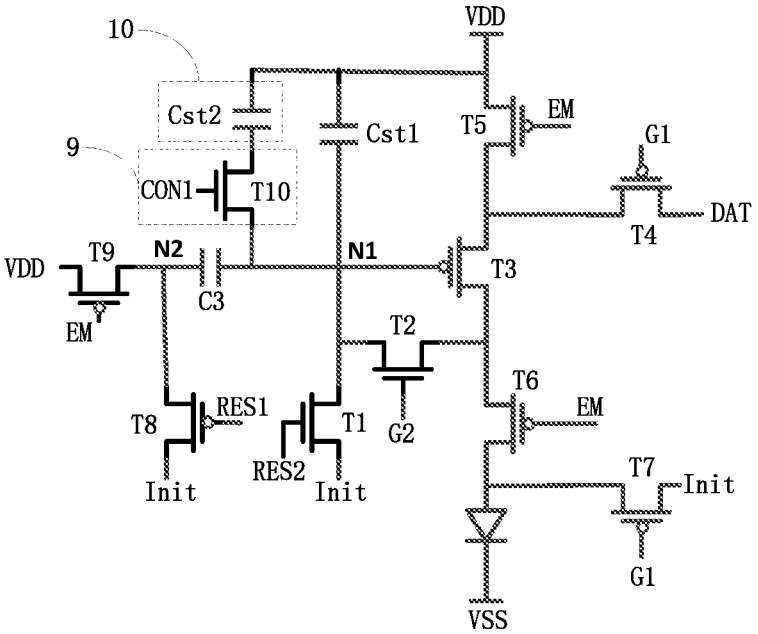
FIG. 13 is a schematic diagram of a third specific structure of a pixel driving circuit provided by an embodiment of the present disclosure.
Figure 14:
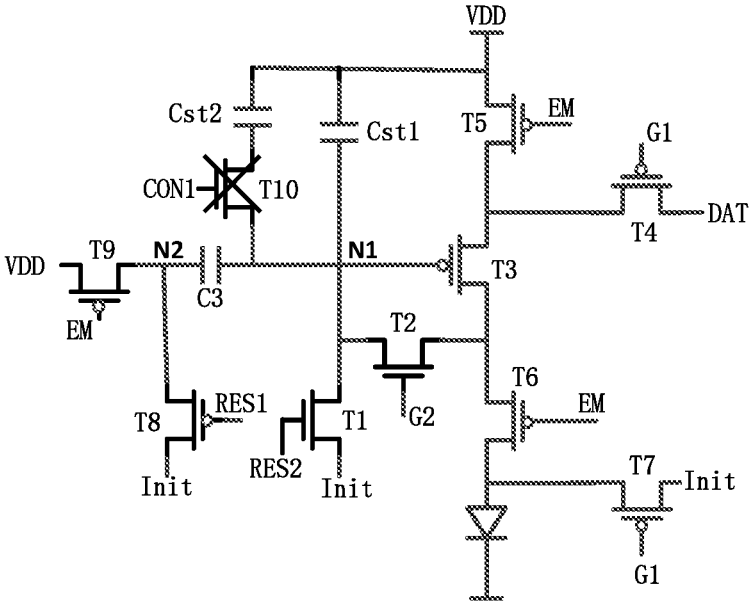
FIG. 14 is a schematic diagram of FIG. 13 in a high frequency state.

As shown in FIGS. 13 and 14, when the display device is at a first operating frequency, the storage control signal inputted by the storage control terminal CON1 is at an invalid level, and under the control of the storage control terminal CON1, the storage control sub-circuit 9 controls the disconnection between the second terminal of the second storage sub-circuit 10 and the control terminal of the driving sub-circuit 2.

Figure 15:
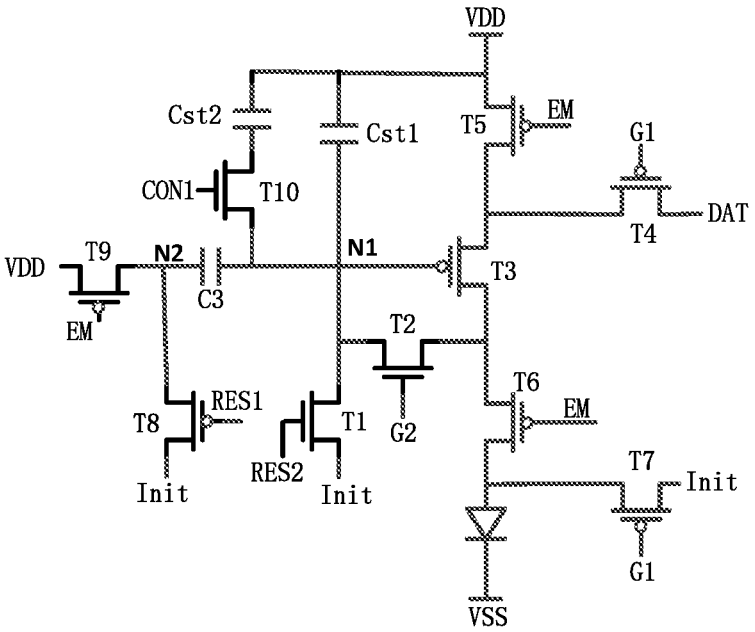
FIG. 15 is a schematic diagram of FIG. 13 in a low frequency state.

As shown in FIGS. 13 and 15, when the display device is at the second operating frequency, the storage control signal inputted by the storage control terminal CON1 is at a valid level, and under the control of the storage control terminal CON1, the storage control sub-circuit 9 controls the connection between the second terminal of the second storage sub-circuit 10 and the control terminal of the driving sub-circuit 2.

Note that the first operating frequency is a high operating frequency, the second operating frequency is a low operating frequency, and the second operating frequency is smaller than the first operating frequency. Illustratively, the second operating frequency is between 1 Hz and 60 Hz, including 1 Hz an 60 Hz, and the first operating frequency is greater than 60 Hz.

In the pixel driving circuit provided in the above embodiments, the second storage sub-circuit 10 and the storage control sub-circuit 9 are arranged so that the second storage sub-circuit 10 is not connected to the pixel driving circuit when the display device is in high frequency display, so that the pixel driving circuit has a small storage capacitance, and the pixel charging rate is ensured. Furthermore, the capacitance value of the capacitor included in the first storage sub-circuit 1 may be preset to be smaller, such as 0.04 pF, so as to increase the pixel charging rate of the data signal writing process.

When the display device is in a low frequency display, the second storage sub-circuit 10 is connected to the pixel driving circuit, so that the capacitance value of the storage capacitor of the pixel driving circuit is: the sum of the capacitance value of the capacitor included in the first storage sub-circuit 1 and the capacitance value of the capacitor included in the second storage sub-circuit 10; this enables the pixel driving circuit to have a large capacitance value of the storage capacitor, reduces the voltage change rate, and ensures that the display device has a low brightness change when displaying at a low frequency.

Therefore, the above embodiment provides a pixel driving circuit capable of dynamically adjusting the capacitance value of the storage capacitor so that the pixel driving circuit is compatible with both high frequency display and low frequency display, and ensures the operating performance of the pixel driving circuit in high frequency display and low frequency display.

Figure 21:
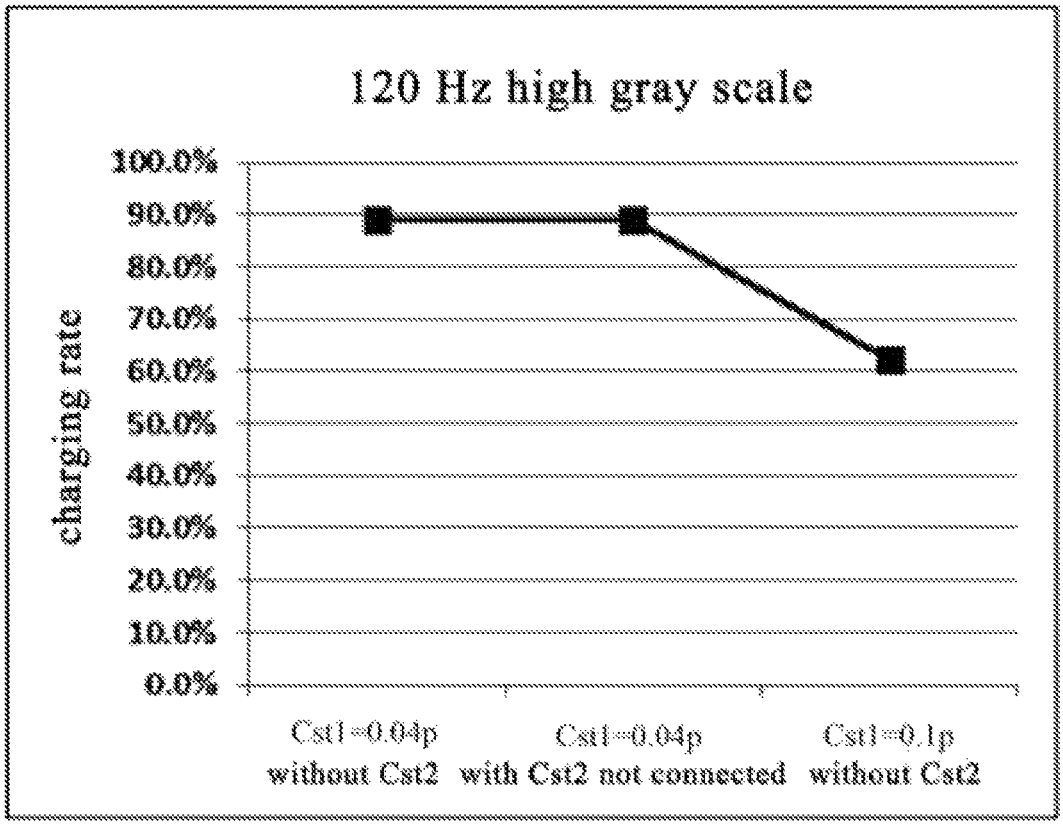
FIG. 21 is a diagram showing a comparison of charging rates at high refresh frequencies in a high gray scale display.
Figure 22:
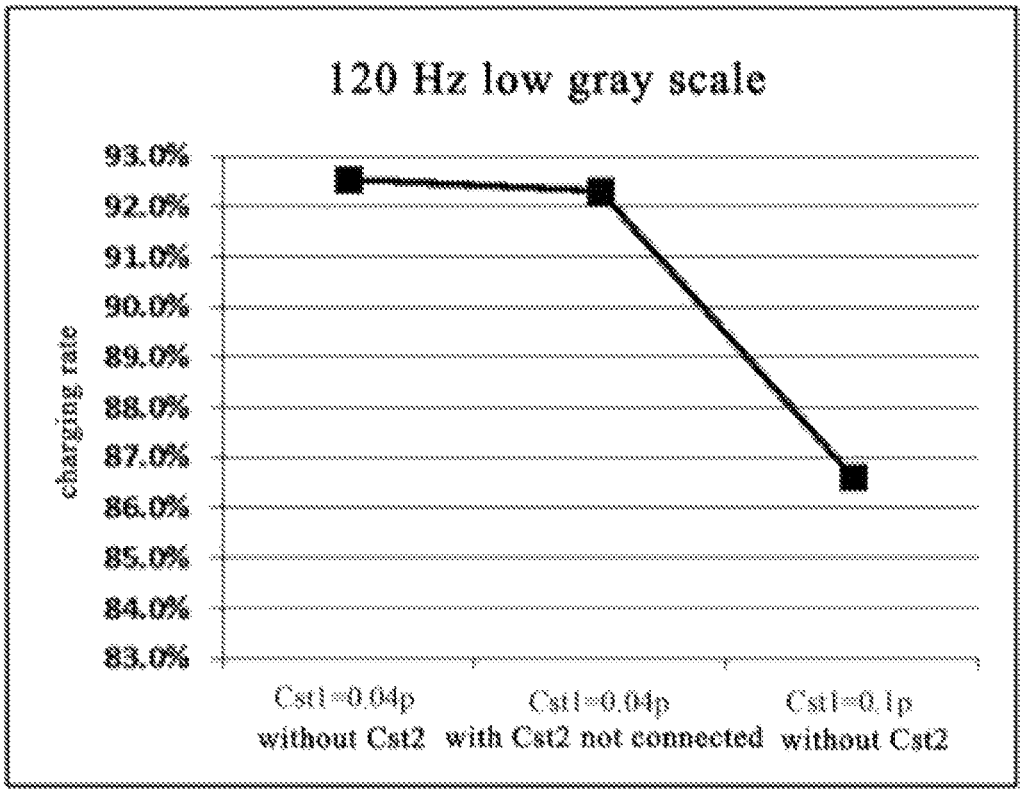
FIG. 22 is a diagram showing a comparison of charging rates at high refresh frequencies in a low gray scale display.

In more detail, as shown in FIGS. 21 and 22, in high gray scale display and low gray scale display, at a high refresh frequency (e.g. QHD, 120 HZ), by comparing the charging rate of the pixel driving circuit provided in the above embodiment with the charging rate of the pixel driving circuit having a storage capacitor having a fixed capacitance value, it can be obtained that: the charging rate of the pixel driving circuit provided in the above embodiment (e.g. the charging rate corresponding to Cst1=0.04 p with or without Cst2) is equivalent to the charging rate of the pixel driving circuit having a small fixed storage capacitance value (e.g. the charging rate corresponding to Cst1=0.04 p without Cst2). In a pixel driving circuit having a storage capacitor with a fixed capacitance value, when the storage capacitance value is small, the charging rate of the pixel driving circuit is high, and when the storage capacitance value is large (e.g. Cst1=0.1 p without Cst2), the charging rate of the pixel driving circuit is low.

Figure 23:
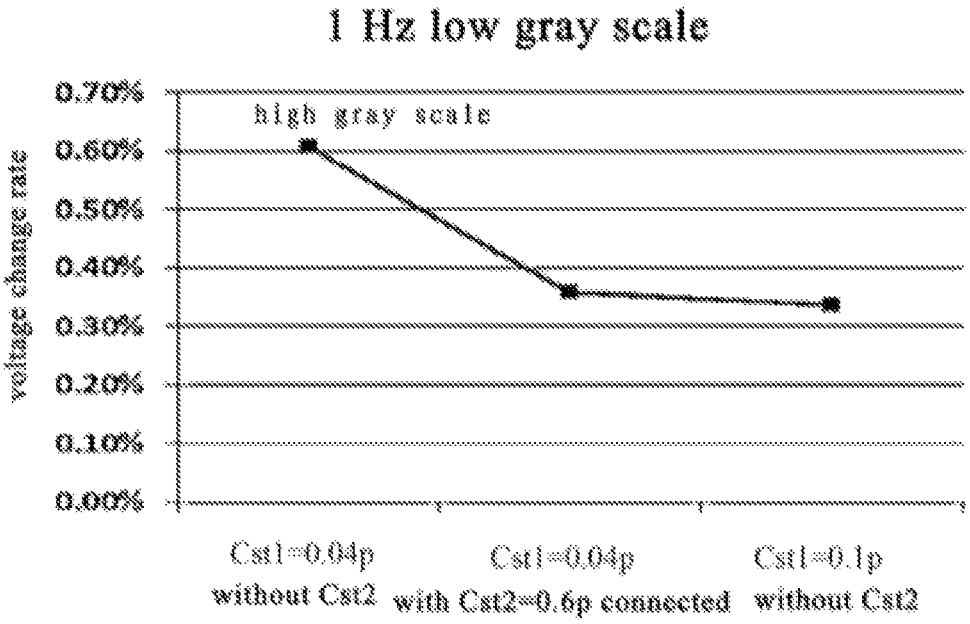
FIG. 23 is a diagram showing a comparison of voltage changing rate at low refresh frequencies in a low gray scale display.

As shown in FIG. 23, in a low gray scale display, at a low refresh frequency (e.g. 1 HZ), by comparing the gate voltage change rate of the driving transistor in the pixel driving circuit before and after one frame provided in the above embodiment with the gate voltage change rate in the pixel driving circuit having a storage capacitor having a fixed capacitance value before and after one frame, it can be obtained that: the gate voltage change rate in the pixel driving circuit before and after one frame (e.g. the voltage change rate corresponding to Cst1=0.04 p with Cst2=0.6 p) provided in the above embodiment is equivalent to the gate voltage change rate in the pixel driving circuit having a storage capacitor with a large fixed capacitance value before and after one frame (e.g. the voltage change rate corresponding to Cst1=0.1 p without Cst2). In the pixel driving circuit with fixed storage capacitance value, when the storage capacitance value is small (e.g. Cst1=0.04 p without Cst2), the gate voltage change rate of the conventional pixel driving circuit is high before and after one frame, and when the storage capacitance value is large, the gate voltage change rate of the conventional pixel driving circuit is low before and after one frame.

As shown in FIGS. 13-15, in some embodiments, the second storage sub-circuit 10 includes a second storage capacitor Cst2, wherein a first terminal of the second storage capacitor Cst2 is electrically connected to the first level signal input terminal VDD; and the storage control sub-circuit 9 includes a tenth transistor T10, a gate electrode of the tenth transistor T10 is electrically connected to the storage control terminal CON1, a first electrode of the tenth transistor T10 is electrically connected to a second terminal of the second storage capacitor Cst2, and a second electrode of the tenth transistor T10 is electrically connected to the control terminal of the driving sub-circuit 2.

Illustratively, the tenth transistor T10 is an N-type transistor, and the valid level of the storage control signal inputted by the storage control terminal CON1 is a high level. When the pixel driving circuit operates in a high frequency state, as shown in FIG. 14, the storage control signal is at a low level, such as VGL, at this time the tenth transistor T10 is turned off, the equivalent storage capacitor of the pixel driving circuit is a first storage capacitor Cst1, and the first storage capacitor Cst1 can be set as a common small capacitor for high frequency driving, such as 0.04 pF, so as to improve the charging rate during the data signal writing process.

When the pixel driving circuit operates in a low frequency state, as shown in FIG. 15, the storage control signal is at a high level, such as VGH, at this time the tenth transistor T10 is turned on, and the equivalent storage capacitor of the pixel driving circuit is that the first storage capacitor Cst1 and the second storage capacitor Cst2 are connected in parallel, namely, the capacitance value of the equivalent storage capacitor is C=Cst1+Cst2, and a capacitance value of the equivalent storage capacitor is large, so that brightness variation when displayed at low frequency is small.

Accordingly, the above embodiment provides a pixel driving circuit in which the storage control signal is controlled to be at VGL or VGH according to a high or low frequency state in which the screen operates, thereby controlling a capacitance value of an equivalent storage capacitor in the pixel driving circuit.

As shown in FIGS. 3 and 6-10, in some embodiments, the pixel driving circuit further includes:

a second reset sub-circuit 11, respectively electrically connected to a reset control terminal RES1, the initialization signal input terminal Iint and the second terminal of the coupling sub-circuit 7, and configured to control the connection or disconnection between the initialization signal input terminal Tint and the second terminal of the coupling sub-circuit 7 under the control of the reset control terminal RES1.

In the reset phase P1, the reset control signal is at a valid level, and under the control of the reset control terminal RES1, the second reset sub-circuit 11 controls the connection between the initialization signal input terminal Tint and the second terminal of the coupling sub-circuit 7; and the voltage of the second terminal of the coupling sub-circuit 7 is reset to Vinit.

In the compensation phase P2 and the light-emitting phase P3, the reset control signal is at an invalid level, and under the control of the reset control terminal RES1, the second reset sub-circuit 11 controls the disconnection between the initialization signal input terminal Tint and the second terminal of the coupling sub-circuit 7.

In the pixel driving circuit provided in the above embodiment, the second reset sub-circuit 11 is provided so that the second terminal of the coupling sub-circuit 7 can be initialized during a reset period, so that the driving current generated by the pixel driving circuit is $I=k(Vdata-Vinit)^2$, thereby avoiding the influence of unstable V1 on the driving current.

Figure 5:
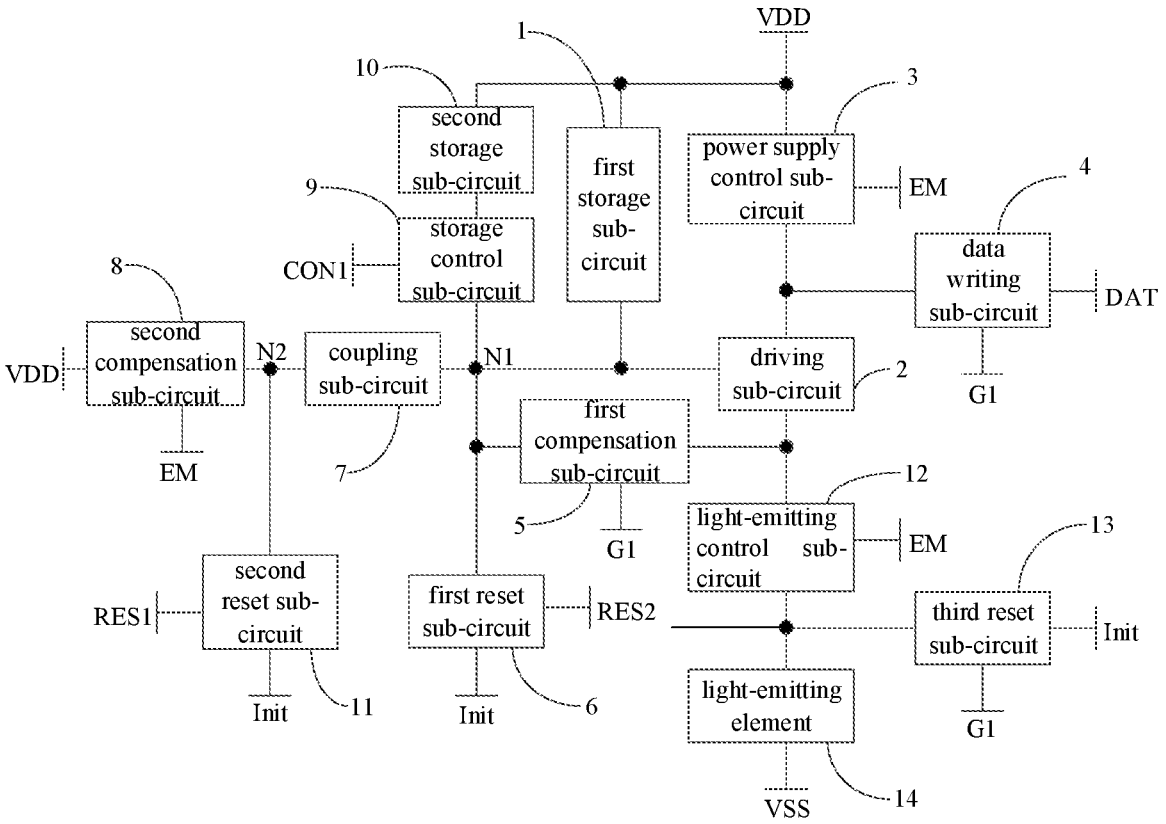
FIG. 5 is a schematic diagram of a fifth basic structure of a pixel driving circuit provided by an embodiment of the present disclosure.

As shown in FIG. 5, in some embodiments, the pixel driving circuit also includes a light-emitting control sub-circuit 12, wherein the second terminal of the driving sub-circuit 2 is electrically connected to the light-emitting element 14 through the light-emitting control sub-circuit 12; and the light-emitting control sub-circuit 12 is respectively electrically connected to the first control terminal EM, the second terminal of the driving sub-circuit 2, and the light-emitting element 14, and configured to control the connection or disconnection between the second terminal of the driving sub-circuit 2 and the light-emitting element 14 under the control of the first control terminal EM.

As shown in FIGS. 6-10, in the reset phase P1 and the compensation phase P2, the first control signal inputted by the first control terminal EM is at an invalid level, and under the control of the first control terminal EM, the lighting control sub-circuit 12 controls the disconnection between the second terminal of the driving sub-circuit 2 and the light-emitting element 14.

In the light-emitting phase P3, the first control signal inputted by the first control terminal EM is at a valid level, and under the control of the first control terminal EM, the light-emitting control sub-circuit 12 controls the connection between the second terminal of the driving sub-circuit 2 and the light-emitting element 14.

In the pixel driving circuit provided in the above embodiment, the light-emitting control sub-circuit 12 is provided so that the light-emitting element 14 does not abnormally emit light in the reset phase P1 and the compensation phase P2, thereby improving the display quality of the display device.

As shown in FIGS. 5-10, in some embodiments, the pixel driving circuit further includes: a third reset sub-circuit 13, respectively electrically connected to the second control terminal G1, the initialization signal input terminal Tint and the light-emitting element 14, and configured to control the connection or disconnection between the initialization signal input terminal Tint and the light-emitting element 14 under the control of the second control terminal G1.

In the reset phase P1 and the light-emitting phase P3, the second control signal inputted by the second control terminal G1 is at an invalid level, and under the control of the second control terminal G1, the third reset sub-circuit 13 controls the disconnection between the initialization signal input terminal Tint and the light-emitting element 14.

In the compensation phase P2, the second control signal inputted by the second control terminal G1 is at a valid level, and under the control of the second control terminal G1, the third reset sub-circuit 13 controls the connection between the initialization signal input terminal Iint and the light-emitting element 14 to reset the anode of the light-emitting element 14.

The embodiment described above provides a pixel driving circuit in which the control signals of many sub-circuits having different functions are the same, so that the pixel driving circuit has the advantage that the required signal type is simple. Furthermore, the control signals of the sub-circuits having different functions may be provided by an existing gate driving circuit (GOA), and thus the pixel driving circuit provided by the above embodiment has an advantage of being compatible with the existing GOA.

As shown in FIGS. 4, 5, and 11-13, in some embodiments, one or more of the first reset sub-circuit 6, the first compensation sub-circuit 5, and the storage control sub-circuit 9 may be implemented using an oxide transistor.

When an oxide transistor having better switching performance is used to realize the function of a sub-circuit, the sub-pixel formed by the pixel driving circuit is a Low Temperature Polycrystalline Oxide (LTPO) pixel having better display performance.

Figure 8:
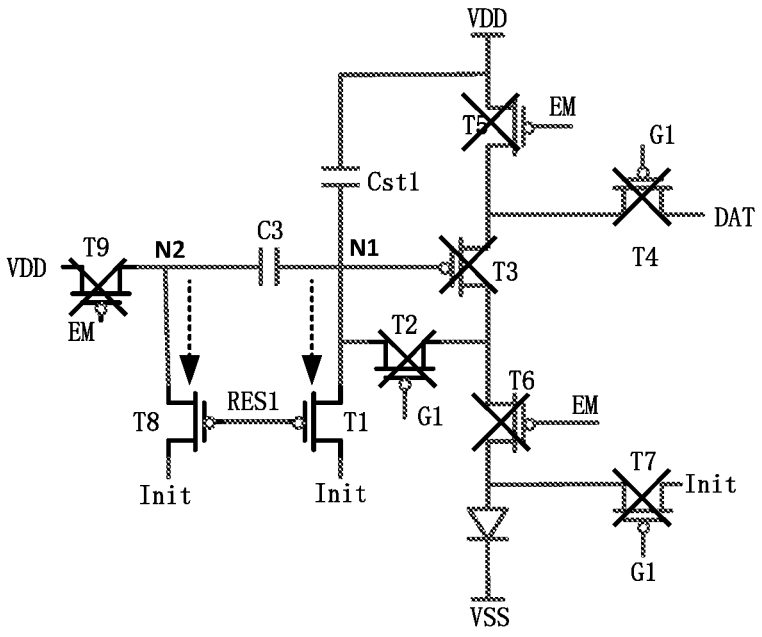
FIG. 8 is a schematic diagram of FIG. 6 during a reset phase.
Figure 9:
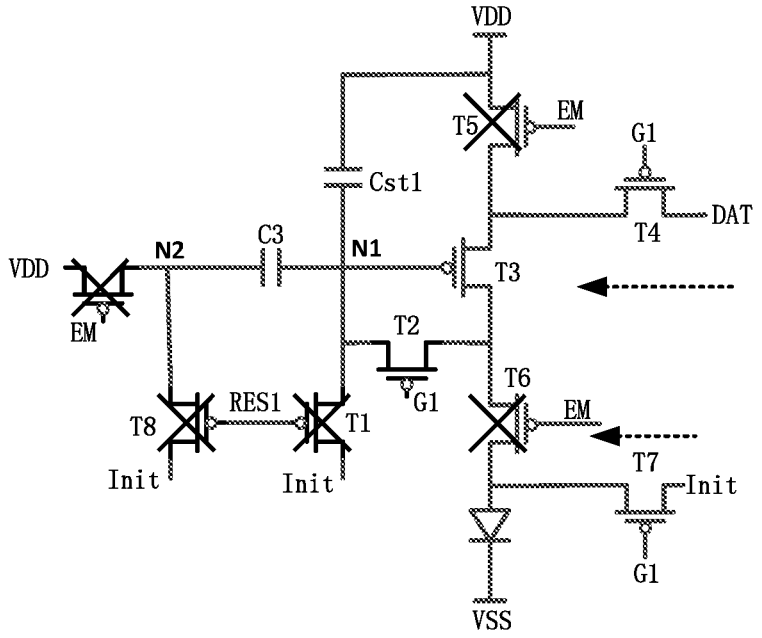
FIG. 9 is a schematic diagram of FIG. 6 during a compensation phase.
Figure 10:
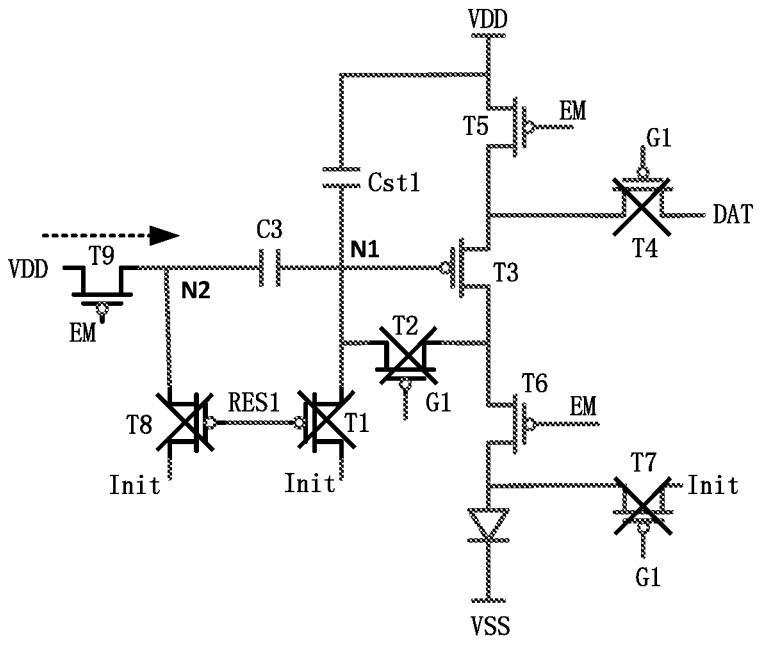
FIG. 10 is a schematic diagram of FIG. 6 during a light-emitting phase.
Figure 11:
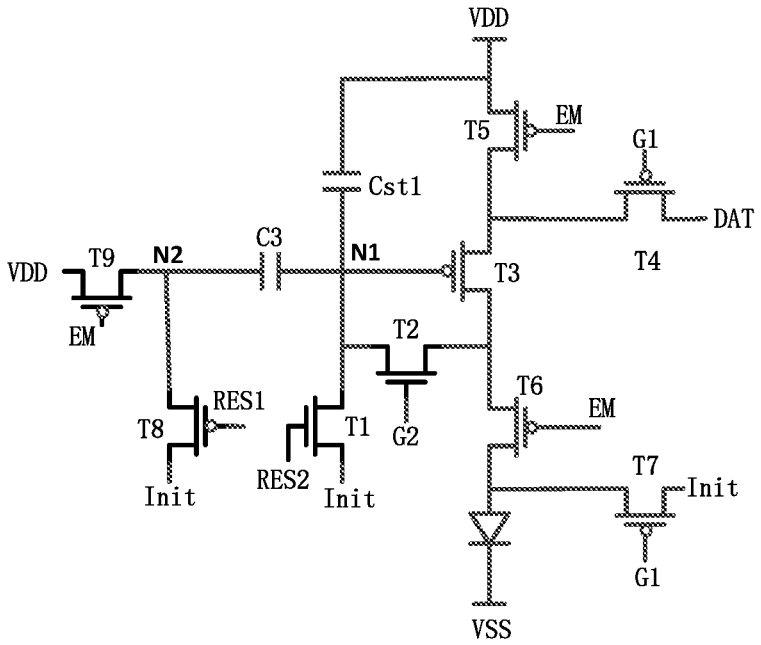
FIG. 11 is a schematic diagram of a second specific structure of a pixel driving circuit provided by an embodiment of the present disclosure.
Figure 12:
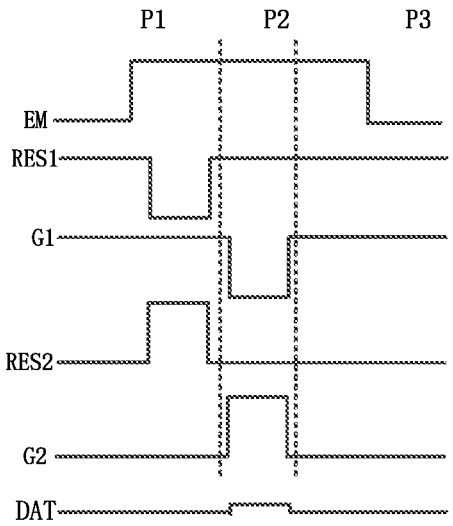
FIG. 12 is a timing diagram corresponding to FIG. 11.
Figure 16:
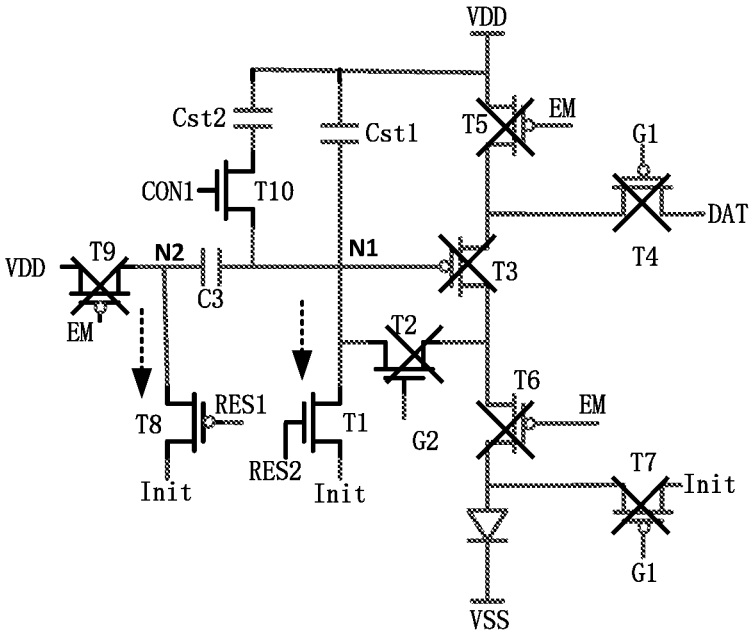
FIG. 16 is a schematic diagram of FIG. 13 during a reset phase.
Figure 17:
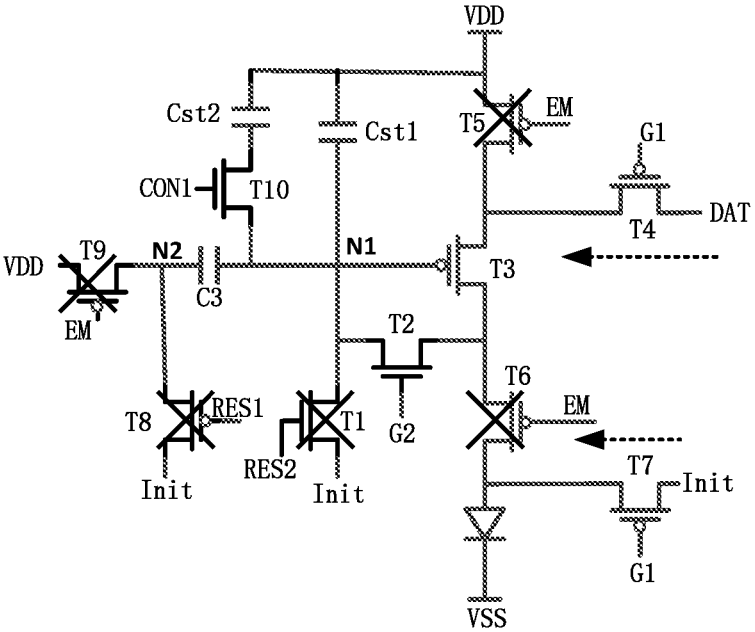
FIG. 17 is a schematic diagram of FIG. 13 during a compensation phase.
Figure 18:
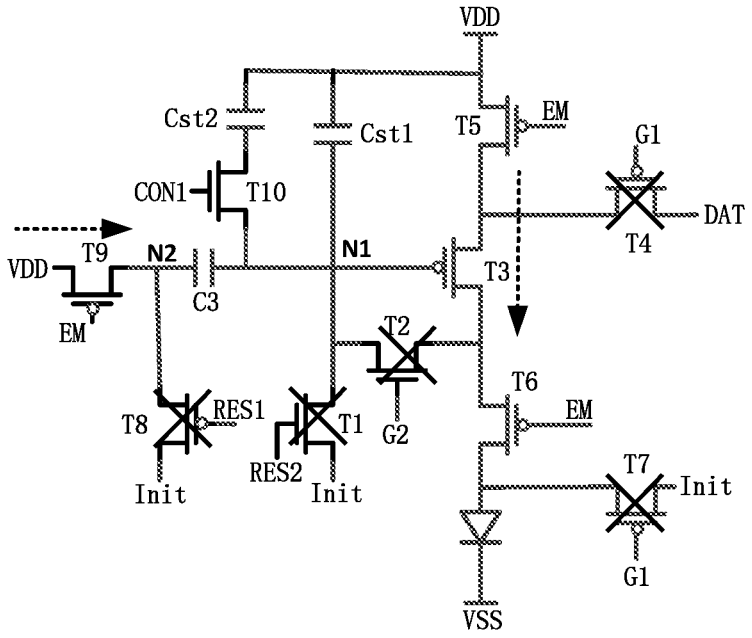
FIG. 18 is a schematic diagram of FIG. 13 during a light-emitting phase.

Illustratively, the first reset sub-circuit 6, the first compensation sub-circuit and the storage control sub-circuit 9 are all implemented using oxide transistors, and the other sub-circuits in the pixel driving sub-circuit are all implemented using P-type low temperature polysilicon transistors; in this case, the operation timing of the pixel driving circuit is as shown in FIG. 12, the first compensation sub-circuit is connected to the control terminal RES2, and the control signal inputted by the control terminal RES2 is valid at a high level, and the specific operation process is as shown in FIG. 16-18, and the operation principle is similar to that of FIG. 8-10, and the detailed description thereof is omitted.

Figure 6:
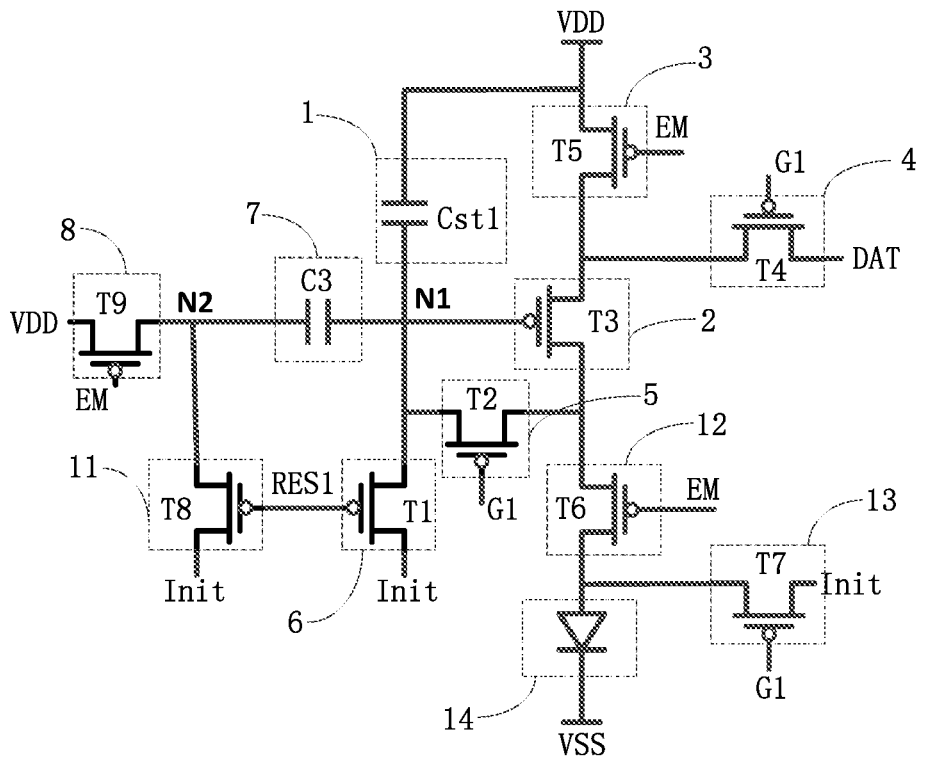
FIG. 6 is a schematic diagram of a first specific structure of a pixel driving circuit provided by an embodiment of the present disclosure.
Figure 7:
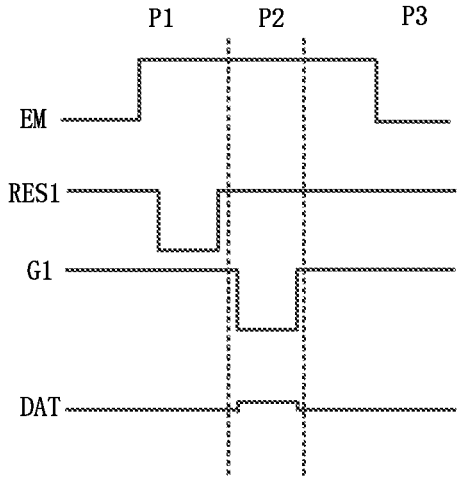
FIG. 7 is a timing diagram corresponding to FIG. 6.

As shown in FIG. 6, in some embodiments, the first storage sub-circuit 1 includes a first storage capacitor Cst1, wherein a first terminal of the first storage capacitor Cst1 is electrically connected to the first level signal input terminal VDD;

the driving sub-circuit 2 includes a third transistor T3, a gate electrode of the third transistor T3 is electrically connected to a second terminal of the first storage capacitor Cst1, and a second electrode of the third transistor T3 is electrically connected to the light-emitting element 14 via the light-emitting control sub-circuit 12;

the first reset sub-circuit 6 includes a first transistor T1, a gate electrode of the first transistor T1 is electrically connected to the reset control terminal RES1, a first electrode of the first transistor T1 is electrically connected to the initialization signal input terminal Iint, and a second electrode of the first transistor T1 is electrically connected to the gate electrode of the third transistor T3;

the first compensation sub-circuit 5 includes a second transistor T2, a first electrode of the second transistor T2 is electrically connected to the second control terminal G1, the first electrode of the second transistor T2 is electrically connected to the second electrode of the third transistor T3, and a second electrode of the second transistor T2 is electrically connected to the gate electrode of the third transistor T3;

the data writing sub-circuit 4 includes a fourth transistor T4, a gate electrode of the fourth transistor T4 is electrically connected to the second control terminal G1, a first electrode of the fourth transistor T4 is electrically connected to the data signal input terminal DAT, and a second electrode of the fourth transistor T4 is electrically connected to a first electrode of the third transistor T3;

the power supply control sub-circuit 3 includes a fifth transistor T5, a gate electrode of the fifth transistor T5 is electrically connected to the first control terminal EM, a first electrode of the fifth transistor T5 is electrically connected to the first level signal input terminal VDD, and a second electrode of the fifth transistor T5 is electrically connected to a first electrode of the third transistor T3;

the coupling sub-circuit 7 includes a coupling capacitor C3, a first terminal of the coupling capacitor C3 is electrically connected to the gate electrode of the third transistor T3; and the second compensation sub-circuit 8 includes a ninth transistor T9, a gate electrode of the ninth transistor T9 is electrically connected to the first control terminal EM, a first electrode of the ninth transistor T9 is electrically connected to the first level signal input terminal VDD, and a second electrode of the ninth transistor T9 is electrically connected to a second terminal of the coupling capacitor C3.

As shown in FIG. 6, in some embodiments, the second reset sub-circuit 11 includes an eighth transistor T8, a gate electrode of the eighth transistor T8 is electrically connected to the reset control terminal RES1, a first electrode of the eighth transistor T8 is electrically connected to the initialization signal input terminal Tint, and a second electrode of the eighth transistor T8 is electrically connected to the second terminal of the coupling capacitor C3.

As shown in FIG. 6, in some embodiments, the light-emitting control sub-circuit 12 includes a sixth transistor T6, a gate electrode of the sixth transistor T6 is electrically connected to the first control terminal EM, a first electrode of the sixth transistor T6 is electrically connected to the second terminal of the driving sub-circuit 2, and a second electrode of the sixth transistor T6 is electrically connected to the light-emitting element 14.

As shown in FIG. 6, in some embodiments, the third reset sub-circuit 13 includes a seventh transistor T7, a gate electrode of the seventh transistor T7 is electrically connected to the second control terminal G1, a first electrode of the seventh transistor T7 is electrically connected to the initialization signal input terminal Tint, and a second electrode of the seventh transistor T7 is electrically connected to the light-emitting element 14.

Illustratively, each of the transistors used in the pixel driving circuit provided in the above embodiments is a P-type transistor.

When the pixel driving circuit provided in the above embodiment adopts the above specific structure, the specific operation process is as follows.

In the reset phase P1, the first transistor T1 and the eighth transistor T8 are turned on, the N1 node and the N2 node are reset, and the voltages of the N1 node and the N2 node are changed to Vinit;

In the compensation phase P2, the second transistor T2, the third transistor T3, the fourth transistor T4 and the seventh transistor T7 are all turned on, and the first transistor T1, the fifth transistor T5, the sixth transistor T6, the eighth transistor T8 and the ninth transistor T9 are all turned off.

In the light-emitting phase P3, the third transistor T3, the fifth transistor T5, the sixth transistor T6 and the ninth transistor T9 are all turned on, and the first transistor T1, the second transistor T2, the fourth transistor T4, the seventh transistor T7 and the eighth transistor T8 are all turned off.

Embodiments of the present disclosure also provide a display device including the pixel drive circuit provided by the embodiments described above.

Due to the pixel driving circuit provided in the above embodiment, both the threshold voltage Vth corresponding to the driving sub-circuit 2 and the voltage value Vd of the first level signal can be compensated, so as to eliminate the influence of Vth drift and Vd variation due to IR Drop on the driving current I, and effectively improve the display quality of the display device.

Accordingly, the embodiments of the present disclosure provide a display device that, when including the above pixel driving circuit, also has the above advantages and will not be described in detail herein.

Note that the display device may be: any product or component with display function such as a television, a display, a digital photo frame, a mobile phone and a tablet computer.

Embodiments of the present disclosure also provide a method of for driving the pixel driving circuit provided in the above embodiments, the driving method includes the following steps: within each display cycle, in a reset phase P1, under a control of a reset control terminal RES1, a first reset sub-circuit 6 controls the connection between an initialization signal input terminal Iint and a control terminal of a driving sub-circuit 2 to reset the control terminal of the driving sub-circuit 2;

in a compensation phase P2, under the control of the reset control terminal RES1, the first reset sub-circuit 6 controls the disconnection between the initialization signal input terminal Iint and the control terminal of the driving sub-circuit 2; under the control of a second control terminal G1, a first compensation sub-circuit 5 controls the connection between a second terminal of the driving sub-circuit 2 and the control terminal of the driving sub-circuit 2; a data signal input terminal DAT inputs a data signal, and under the control of the second control terminal G1, a data writing sub-circuit 4 controls the connection between the data signal input terminal DAT and a first terminal of the driving sub-circuit 2; a potential of the control terminal of the driving sub-circuit 2 is compensated to Vdata+Vth, wherein Vth is a threshold voltage corresponding to the driving sub-circuit 2, and Vdata is a voltage value of a data signal; and in the light-emitting phase P3, under the control of the second control terminal G1, the first compensation sub-circuit 5 controls the disconnection between the second terminal of the driving sub-circuit 2 and the control terminal of the driving sub-circuit 2; under the control of the second control terminal G1, the data writing sub-circuit 4 controls the disconnection between the data signal input terminal DAT and the first terminal of the driving sub-circuit 2; the first level signal input terminal VDD inputs a first level signal, and under the control of the first control terminal EM, a power supply control sub-circuit 3 controls the connection between the first level signal input terminal VDD and the first terminal of the driving sub-circuit 2; under the control of the first control terminal EM, a second compensation sub-circuit 8 controls the connection between the first level signal input terminal VDD and a second terminal of a coupling sub-circuit 7; so that a potential of the control terminal of the driving sub-circuit 2 is Vdata+Vth+Vd−V1, wherein V1 is an initial voltage of the second terminal of the coupling sub-circuit 7, and Vd is a voltage value of the first level signal, and the driving sub-circuit 2 drives a light-emitting element 14 to emit light.

When the pixel driving circuit is driven by the driving method provided in the embodiment of the present disclosure, both the threshold voltage Vth corresponding to the driving sub-circuit 2 and the voltage value Vd of the first level signal can be compensated, so as to eliminate the influence of Vth drift and Vd variation due to IR Drop on the driving current I, and effectively improve the display quality of the display device.

In some embodiments, the pixel driving circuit is applied to a display device, and when the pixel driving circuit further includes a second storage sub-circuit 10 and a storage control sub-circuit 9, the driving method further includes the following steps.

When the display device is at a first operating frequency, under the control of a storage control terminal CON1, the storage control sub-circuit 9 controls the disconnection between a second terminal of a second storage sub-circuit 10 and the control terminal of the driving sub-circuit 2.

When the display device is at a second operating frequency, under the control of the storage control terminal CON1, the storage control sub-circuit 9 controls the connection between the second terminal of the second storage sub-circuit 10 and the control terminal of the driving sub-circuit 2.

The second operating frequency is less than the first operating frequency.

When the pixel driving circuit is driven by the driving method provided in the above embodiment, when the display device is in high frequency display, the second storage sub-circuit 10 is not connected to the pixel driving circuit, so that the pixel driving circuit has a small storage capacitance value and the pixel charging rate is ensured. and when the display device is in a low frequency display, the second storage sub-circuit 10 is connected to the pixel driving circuit, so that the capacitance value of the storage capacitor of the pixel driving circuit is: the sum of the capacitance value of the capacitor included in the first storage sub-circuit 1 and the capacitance value of the capacitor included in the second storage sub-circuit 10; this enables the pixel driving circuit to have a large storage capacitance value, reduces the voltage change rate, and ensures that the display device has a low brightness change when displaying at a low frequency.

Therefore, when the pixel driving circuit is driven by the driving method provided in the above embodiment, the capacitance value of the storage capacitor can be dynamically adjusted, so that the pixel driving circuit is compatible with both high frequency display and low frequency display, and ensures the operating performance of the pixel driving circuit in high frequency display and low frequency display.

In some embodiments, when the pixel driving circuit further includes the second reset sub-circuit 11, the driving method further includes the following steps:

in the reset phase P1, under the control of a reset control terminal RES1, the second reset sub-circuit 11 controls the connection between the initialization signal input terminal Iint and the second terminal of the coupling sub-circuit 7; and in the compensation phase P2 and the light-emitting phase P3, under the control of the reset control terminal RES1, the second reset sub-circuit 11 controls the disconnection between the initialization signal input terminal Iint and the second terminal of the coupling sub-circuit 7.

When the pixel driving circuit is driven by the driving method provided in the above embodiment, the second terminal of the coupling sub-circuit 7 can be initialized during the reset phase, so that the driving current generated by the pixel driving circuit is $I=k(Vdata-Vinit)^2$, thereby avoiding the influence of unstable V1 on the driving current.

It should be noted that the various embodiments in the present specification are described in a progressive manner, and that similar parts between the different embodiments can be referred to each other, and that each embodiment focuses on differences from other embodiments. In particular, since the method embodiments are substantially similar to the product embodiments, they will be described with reference to the description of the product embodiments.

Unless defined otherwise, technical or scientific terms used herein shall have the ordinary meaning as understood by one of ordinary skill in the art to which this disclosure belongs. As used in this disclosure, the terms "first, second" and the like do not denote any order, quantity, or importance, but rather are used to distinguish one part from another. The word "comprise" or "include" or the like, means that the element or object preceded by the word is inclusive of the element or object listed after the word and its equivalents, and does not exclude other elements or objects. Similar terms such as "connect" or "couple" or "join" are not limited to physical or mechanical connections, but may include electrical connections, whether direct or indirect. "Upper, lower, left, right" and the like are used merely to denote relative positional relationships, which may change accordingly when the absolute position of the object being described changes.

It can be understood that when an element such as a layer, film, area or substrate is referred to as being "upper" or "lower" located on the other element, it can be "directly upper" or "lower" located on the other element or intervening elements may be present.

In the description of the above embodiments, the particular features, structures, materials, or characteristics may be combined in any suitable manner in any one or more of the embodiments or examples.

The above description is merely specific implementations of the present disclosure, and the scope of protection of the present disclosure is not limited thereto, and any modification and substitution apparent to those skilled in the art without departing from the technical scope of the present disclosure shall be covered by the scope of protection of the present disclosure. Accordingly, the scope of protection of the present disclosure is as set forth in the claims.

What is claimed is:

1. A pixel driving circuit for driving a light-emitting element to emit light, comprising:

a first storage sub-circuit, wherein the first storage sub-circuit comprises a first storage capacitor, and a first terminal of the first storage capacitor is directly electrically connected to the first level signal input terminal;

a driving sub-circuit, wherein a control terminal of the driving sub-circuit is directly electrically connected to a second terminal of the first storage capacitor, and a second terminal of the driving sub-circuit is electrically connected to the light-emitting element;

a power supply control sub-circuit, respectively electrically connected to a first control terminal, the first level signal input terminal and a first terminal of the driving sub-circuit;

a data writing sub-circuit, respectively electrically connected to a second control terminal, a data signal input terminal and the first terminal of the driving sub-circuit;

a first compensation sub-circuit, respectively electrically connected to the second control terminal, the second terminal of the driving sub-circuit and the control terminal of the driving sub-circuit;

a first reset sub-circuit, respectively electrically connected to a reset control terminal, an initialization signal input terminal and the control terminal of the driving sub-circuit;

a coupling sub-circuit, wherein the coupling sub-circuit comprises a coupling capacitor, wherein a first terminal of the coupling capacitance is directly electrically connected to a second terminal of the first storage capacitor and the control terminal of the driving sub-circuit;

a second compensation sub-circuit, respectively electrically connected to the first control terminal, a second terminal of the coupling sub-circuit and the first level signal input terminal, and configured to control the connection or disconnection between the second terminal of the coupling sub-circuit and the first level signal input terminal under a control of the first control terminal;

a second reset sub-circuit, respectively electrically connected to a reset control terminal, the initialization signal input terminal and the second terminal of the coupling sub-circuit, and configured to control the connection or disconnection between the initialization signal input terminal and the second terminal of the coupling sub-circuit under the control of the reset control terminal;

a third reset sub-circuit, respectively electrically connected to the second control terminal, the initialization signal input terminal and the light-emitting element, and configured to control the connection or disconnection between the initialization signal input terminal and the light-emitting element under the control of the second control terminal;

wherein the first reset sub-circuit includes a first transistor, a gate electrode of the first transistor is electrically connected to the reset control terminal, a first electrode of the first transistor is electrically connected to the initialization signal input terminal, and a second electrode of the first transistor is electrically connected to the gate electrode of a third transistor, the second reset sub-circuit comprises an eighth transistor, a gate electrode of the eighth transistor is electrically connected to the reset control terminal, a first electrode of the eighth transistor is electrically connected to the initialization signal input terminal, and a second electrode of the eighth transistor is electrically connected to the second terminal of the coupling capacitor, the third reset sub-circuit comprises a seventh transistor, a gate electrode of the seventh transistor is electrically connected to the second control terminal, a first electrode of the seventh transistor is electrically connected to the initialization signal input terminal, and a second electrode of the seventh transistor is electrically connected to the light-emitting element, wherein the gate electrode of the first transistor is directly connected to the gate electrode of the eighth transistor, the reset control terminal and the second control terminal are different terminals.

2. The pixel driving circuit according to claim 1, further comprising:

a second storage sub-circuit, wherein a first terminal of the second storage sub-circuit is electrically connected to the first level signal input terminal; and a storage control sub-circuit, respectively electrically connected to a storage control terminal, a second terminal of the second storage sub-circuit and the control terminal of the driving sub-circuit, and configured to control the connection or disconnection between the second terminal of the second storage sub-circuit and the control terminal of the driving sub-circuit under the control of the storage control terminal.

3. The pixel driving circuit according to claim 2, wherein one or more of the first reset sub-circuit, the first compensation sub-circuit, and the storage control sub-circuit are implemented using an oxide transistor.

4. The pixel driving circuit according to claim 2, wherein the second storage sub-circuit comprises a second storage capacitor, and a first terminal of the second storage capacitor is electrically connected to the first level signal input terminal; and the storage control sub-circuit comprises a tenth transistor, a gate electrode of the tenth transistor is electrically connected to the storage control terminal, a first electrode of the tenth transistor is electrically connected to a second terminal of the second storage capacitor, and a second electrode of the tenth transistor is electrically connected to the control terminal of the driving sub-circuit.

5. The pixel driving circuit of claim 1, further comprising a light-emitting control sub-circuit, wherein the second terminal of the driving sub-circuit is electrically connected to the light-emitting element through the light-emitting control sub-circuit; and the light-emitting control sub-circuit is respectively electrically connected to the first control terminal, the second terminal of the driving sub-circuit, and the light-emitting element, and configured to control the connection or disconnection between the second terminal of the driving sub-circuit and the light-emitting element under the control of the first control terminal.

6. The pixel driving circuit according to claim 5, wherein the light-emitting control sub-circuit comprises a sixth transistor, a gate electrode of the sixth transistor is electrically connected to the first control terminal, a first electrode of the sixth transistor is electrically connected to the second terminal of the driving sub-circuit, and a second electrode of the sixth transistor is electrically connected to the light-emitting element.

7. The pixel driving circuit according to claim 1, wherein the driving sub-circuit comprises a third transistor, a gate electrode of the third transistor is electrically connected to a second terminal of the first storage capacitor, and a second electrode of the third transistor is electrically connected to the light-emitting element.

8. The pixel driving circuit according to claim 1, wherein the first compensation sub-circuit comprises a second transistor, a gate electrode of the second transistor is electrically connected to the second control terminal, the first electrode of the second transistor is electrically connected to the second electrode of the third transistor, and a second electrode of the second transistor is electrically connected to the gate electrode of the third transistor.

9. The pixel driving circuit according to claim 1, wherein the data writing sub-circuit comprises a fourth transistor, a gate electrode of the fourth transistor is electrically connected to the second control terminal, a first electrode of the fourth transistor is electrically connected to the data signal input terminal, and a second electrode of the fourth transistor is electrically connected to a first electrode of the third transistor.

10. The pixel driving circuit according to claim 1, wherein the power supply control sub-circuit comprises a fifth transistor, a gate electrode of the fifth transistor is electrically connected to the first control terminal, a first electrode of the fifth transistor is electrically connected to the first level signal input terminal, and a second electrode of the fifth transistor is electrically connected to the first electrode of the third transistor; wherein a first terminal of the coupling capacitance is electrically connected to the gate electrode of the third transistor; and the second compensation sub-circuit comprises a ninth transistor, wherein a gate electrode of the ninth transistor is electrically connected to the first control terminal, a first electrode of the ninth transistor is electrically connected to the first level signal input terminal, and a second electrode of the ninth transistor is electrically connected to a second terminal of the coupling capacitor.

11. A display device, comprising the pixel driving circuit according to claim 1.

12. A method for driving the pixel driving circuit according to claim 1, comprising: within each display period, in a reset phase, under a control of a reset control terminal, a first reset sub-circuit controlling the connection between an initialization signal input terminal and a control terminal of a driving sub-circuit to reset the control terminal of the driving sub-circuit;

in a compensation phase, under the control of the reset control terminal, the first reset sub-circuit controlling the disconnection between the initialization signal input terminal and the control terminal of the driving sub-circuit; under the control of a second control terminal, a first compensation sub-circuit controlling the connection between a second terminal of the driving sub-circuit and the control terminal of the driving sub-circuit; a data signal input terminal inputting a data signal, and under the control of the second control terminal, a data writing sub-circuit controlling the connection between the data signal input terminal and a first terminal of the driving sub-circuit; a potential of the control terminal of the driving sub-circuit being compensated to Vdata+Vth, wherein Vth is a threshold voltage corresponding to the driving sub-circuit, and Vdata is a voltage value of a data signal; and in the light-emitting phase, under the control of the second control terminal, the first compensation sub-circuit controlling the disconnection between the second terminal of the driving sub-circuit and the control terminal of the driving sub-circuit; under the control of the second control terminal, the data writing sub-circuit controlling the disconnection between the data signal input terminal and the first terminal of the driving sub-circuit; the first level signal input terminal inputting a first level signal, and under the control of the first control terminal, a power supply control sub-circuit controlling the connection between the first level signal input terminal and the first terminal of the driving sub-circuit; under the control of the first control terminal, a second compensation sub-circuit controlling the connection between the first level signal input terminal and a second terminal of a coupling sub-circuit, so that a potential of the control terminal of the driving sub-circuit is changed to Vdata+Vth+Vd−V1, wherein V1 is an initial voltage of the second terminal of the coupling sub-circuit, and Vd is a voltage value of the first level signal, and the driving sub-circuit drives a light-emitting element to emit light.

13. The method according to claim 12, wherein the pixel driving circuit is applied to a display device, and when the pixel driving circuit further comprises a second storage sub-circuit and a storage control sub-circuit, the method further comprises:

when the display device is at a first operating frequency, under the control of a storage control terminal, the storage control sub-circuit controlling the disconnection between a second terminal of a second storage sub-circuit and the control terminal of the driving sub-circuit; and when the display device is at a second operating frequency, under the control of the storage control terminal, the storage control sub-circuit controlling the connection between the second terminal of the second storage sub-circuit and the control terminal of the driving sub-circuit, wherein the second operating frequency is less than the first operating frequency.

14. The method according to claim 12, wherein, when the pixel driving circuit further comprises a second reset sub-circuit, the method further comprises:

in the reset phase, under the control of a reset control terminal, the second reset sub-circuit controlling the connection between the initialization signal input terminal and the second terminal of the coupling sub-circuit; and in the compensation phase and the light-emitting phase, under the control of the reset control terminal, the second reset sub-circuit controlling the disconnection between the initialization signal input terminal and the second terminal of the coupling sub-circuit.

* * * * *